US007255541B2

(12) United States Patent
Kuramoto et al.

(10) Patent No.: US 7,255,541 B2
(45) Date of Patent: Aug. 14, 2007

(54) FLUID PUMP

(75) Inventors: Satoru Kuramoto, Kariya (JP); Masahiro Kawaguchi, Kariya (JP); Shinya Yamamoto, Kariya (JP); Nobuaki Hoshino, Kariya (JP); Mamoru Kuwahara, Kariya (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 703 days.

(21) Appl. No.: 10/658,443

(22) Filed: Sep. 8, 2003

(65) Prior Publication Data

US 2004/0126255 A1 Jul. 1, 2004

(30) Foreign Application Priority Data

Sep. 10, 2002 (JP) ..... P2002-264328

(51) Int. Cl.
*F04B 17/00* (2006.01)

(52) U.S. Cl. ..... 417/410.3

(58) Field of Classification Search ..... 417/410.3
See application file for complete search history.

(56) References Cited

U.S. PATENT DOCUMENTS

| | | | | |
|---|---|---|---|---|
| 4,363,631 | A | 12/1982 | Wloka | 464/181 |
| 4,990,069 | A | 2/1991 | Guittet et al. | 418/9 |
| 5,620,311 | A * | 4/1997 | Wetzel | 417/415 |
| 5,674,051 | A | 10/1997 | Maruyama | 417/3 |
| 5,879,139 | A | 3/1999 | Hayashi et al. | 417/292 |
| 6,361,293 | B1 * | 3/2002 | Harper et al. | 417/410.3 |
| 6,474,959 | B2 * | 11/2002 | Eisert | 417/423.14 |

FOREIGN PATENT DOCUMENTS

| | | | |
|---|---|---|---|
| DE | 1 653 741 | | 5/1971 |
| DE | 27 17 392 | | 10/1978 |
| EP | 0 719 940 | A | 7/1996 |
| EP | 1 201 927 | A2 | 5/2002 |
| GB | 688 311 | | 3/1953 |
| JP | 59103990 | A * | 6/1984 |
| JP | 8078300 | | 3/1996 |
| JP | 11075447 | A * | 3/1999 |

* cited by examiner

*Primary Examiner*—Cheryl Tyler
*Assistant Examiner*—Vikansha Dwivedi
(74) *Attorney, Agent, or Firm*—Woodcock Washburn LLP

(57) ABSTRACT

A fluid pump includes a housing, a drive source, a rotary unit and a pumping mechanism. The drive source is accommodated in the housing and includes a rotary member for rotation. The rotary unit includes the rotary member and a rotary shaft, which is operatively connected to the rotary member for rotation. The rotary unit forming an engaging portion for engaging with a maintenance tool which is prepared outside the housing. The pumping mechanism is placed in the housing and is operated in accordance with the rotation of the rotary shaft. An allowing means is formed in the housing for allowing the maintenance tool to engage with the engaging portion so as to face the engaging portion. The rotary shaft is rotated by rotating the maintenance tool in a state that the maintenance tool is engaged with the engaged portion.

18 Claims, 3 Drawing Sheets

FLUID PUMP

BACKGROUND OF THE INVENTION

The present invention relates to a fluid pump including a pumping mechanism and a drive source in a housing, the pumping mechanism being run by rotation of a rotary shaft and the drive source driving the rotary shaft of the pumping mechanism.

Japanese Unexamined Patent Publication No. 8-78300 discloses a fluid pump. In this prior art, in a process for manufacturing a semiconductor, a vacuum pump is used for exhausting gas reaction product from a semiconductor machining apparatus. In the vacuum pump, gas reaction product can be solidified therein. The solidified matter is exhausted outside the vacuum pump together with gas reaction product during the operation of the vacuum pump is run. Therefore, unless an excess gas reaction product is solidified, continuous operation of the vacuum pump is not interrupted.

However, after the operation of the vacuum pump is stopped in such a state that the solidified matter exists in the vacuum pump, when the vacuum pump is operated once again, the vacuum pump requires an excess amount of starting torque thereof. Thereby, it may become impossible that the vacuum pump re-starts depending on the drive source such as an electric motor. That is, if the solidified matter gets into a clearance between a rotary member and a housing, the clearance is reduced as a consequence of a drop in temperature of the vacuum pump. Thereby, the rotary member and the housing are pressed and adhered to each other so as to sandwich the solidified matter.

In order to solve the above problem, the vacuum pump is conventionally overhauled before re-starting. Thereby, the solidified matter that is accumulated in the vacuum pump is removed.

However, in a prior art, every time the vacuum pump is re-started, the vacuum pump has to be overhauled. This overhaul causes trouble to an operator.

SUMMARY OF THE INVENTION

The present invention relates to a fluid pump which is easily maintained.

The present invention has the following feature. A fluid pump includes a housing, a drive source, a rotary unit and a pumping mechanism. The drive source is accommodated in the housing and includes a rotary member for rotation. The rotary unit includes the rotary member and a rotary shaft, which is operatively connected to the rotary member for rotation. The rotary unit forming an engaging portion for engaging with a maintenance tool which is prepared outside the housing. The pumping mechanism is placed in the housing and is operated in accordance with the rotation of the rotary shaft. An allowing means is formed in the housing for allowing the maintenance tool to engage with the engaging portion so as to face the engaging portion. The rotary shaft is rotated by rotating the maintenance tool in a state that the maintenance tool is engaged with the engaged portion.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
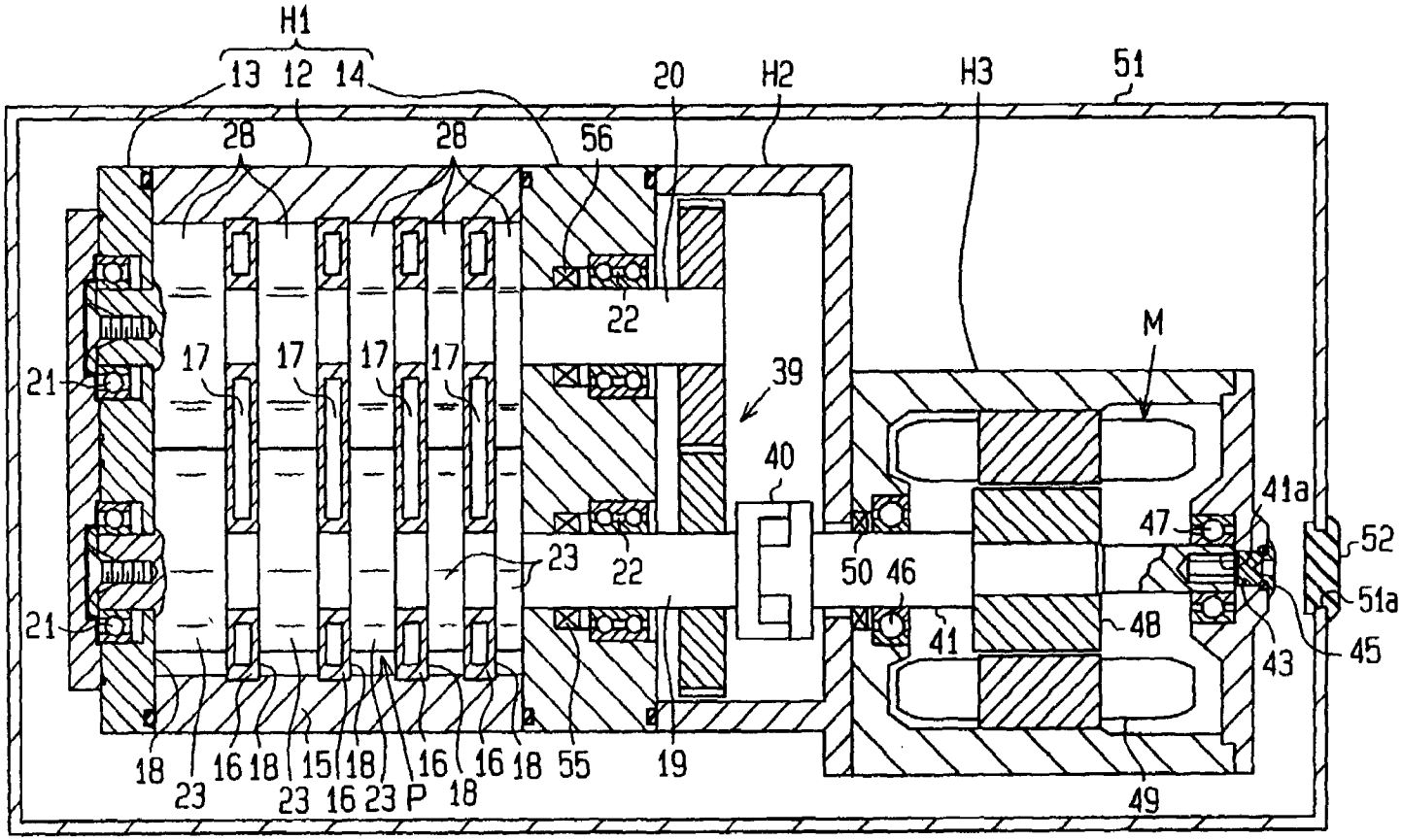
FIG. 1 is a longitudinal sectional view illustrating a vacuum pump according to a first preferred embodiment of the present invention.

A fluid pump according to a first preferred embodiment of the present invention will now be described with reference to FIGS. 1, 2A and 2B. In the first preferred embodiment, a vacuum pump is adopted as the fluid pump. In FIG. 1, a left side of the drawing is a front side and a right side thereof is a rear side.

As shown in FIG. 1, the vacuum pump is used in a process of manufacturing a semiconductor in order to exhaust gas reaction product such as ammonium chloride from a semiconductor machining apparatus, which is not shown in the drawing. The ammonium chloride is hereinafter referred to as a gas.

Still referring to FIG. 1, the vacuum pump includes a pump housing H1, a gear housing H2 and a motor housing H3. The rear end of the pump housing H1 is joined to the front end of the gear housing H2. Also, the rear end of the gear housing H2 is joined to the front end of the motor housing H3. The pump housing H1, the gear housing H2 and the motor housing H3 form a housing of the vacuum pump or a vacuum pump housing. The pump housing H1 includes a rotor housing 12, a front housing 13 and a rear housing 14. The rear end of the front housing 13 is joined to the front end of the rotor housing 12. Also, the rear end of the rotor housing 12 is joined to the front end of the rear housing 14. The pump housing H1 accommodates a multi-stage roots type pumping mechanism P.

The rotor housing 12 includes a cylinder block 15 and a plurality of partition walls 16. The partition walls 16 are placed from the front side of the rotor housing 12 to the rear side thereof so as to parallel each other. A pump chamber 18 is defined in a space between the front housing 13 and the partition wall 16, which is placed at the front end of the rotor housing 12. In a similar manner, a pump chamber 18 is defined in a space between the partition walls 16, which are located next to each other. Further, in a similar manner, a pump chamber 18 is defined in a space between the partition wall 16, which is placed at the rear end of the rotor housing 12, and the rear housing 14. A passage 17 extends through each of the partition walls 16. Thereby, the pump chambers 18 are interconnected with each other through the passage 17.

Rotary shafts 19 and 20 are each supported for rotation by radial bearings 21 and double-row ball bearings 22 in the pump housing H1. Specifically, the front ends of the rotary shafts 19 and 20 are each supported for rotation by the radial bearings 21 in the front housing 13. Also, the rear ends of the rotary shafts 19 and 20 are each supported for rotation by the double-row ball bearings 22 in the rear housing 14. Therefore, while the radial bearings 21 enable the rotary shafts 19 and 20 to move in the directions of rotary axes of the rotary shafts 19 and 20, the double-row ball bearings 22 receive thrust load. Thereby, the rotary shafts 19 and 20 are located in the directions of rotary axes thereof by the double-row ball bearings 22. Both of the rotary shafts 19 and 20 are placed in such a manner that the rotary axes of the rotary shafts 19 and 20 parallel each other. That is, the rotary axis of the rotary shaft 19 has the same direction as that of the rotary axis 20. The rotary shafts 19 and 20 extend through the partition walls 16. A plurality of rotors 23 is integrally formed with the rotary shaft 19. In the present embodiment, the number of rotors 23 is five. The same number of rotors 28 as the rotors 23 is integrally formed with the rotary shaft 20. The plurality of rotors 23 has the same shape and size as seen along the rotary axis of the rotary shaft 19. Also, the plurality of rotors 28 has the same shape and size as seen along the rotary axis of the rotary shaft 20. However, the thickness of the rotors 23 and 28, that is, the length of the rotors 23 and 28 in the directions of the rotary axes of the rotary shafts 19 and 20, is different from each other and reduces in turn from the front side to the rear side.

In each pump chamber 18, the rotors 23 and 28 are accommodated so as to engage each other. The rotor 23 and the corresponding rotor 28 maintain a slight clearance therebetween. The volume of each pump chamber 18 is set so as to reduce in turn from the front side to the rear side. That is, the volume of the pump chamber 18, which is adjoined to the front housing 13, is the maximum, and the volume of the pump chamber 18, which is adjoined to the rear housing 14, is the minimum.

The gear housing H2 accommodates a transmission gear 39 and a shaft coupling 40. Also, the motor housing H3 accommodates an electric motor M that serves as a drive source. The vacuum pump housing, which includes the pump housing H1, the gear housing H2 and the motor housing H3, is built in a cover 51. Thereby, even if the gas in the vacuum pump housing leaks outside the vacuum pump housing, the cover 51 prevents the leaked gas from being emitted into the atmosphere. The gas, which leaks into the cover 51, is collected and detoxicated by an exhaust gas treating apparatus, which is not shown in FIG. 1.

The electric motor M includes an output shaft 41, a rotor 48 and a stator 49. The output shaft 41 is supported by bearings 46 and 47 in the motor housing H3 for rotation. The rotor 48 is mounted on the output shaft 41. The stator 49 is mounted on the inner circumferential surface of the motor housing H3. The output shaft 41 has the same axis as the rotary axis of the rotary shaft 19 of the pumping mechanism P. The output shaft 41 extends through the motor housing H3 and the gear housing H2. Thereby, the front end of the output shaft 41 is connected to the rear end of the shaft coupling 40, which serves as a rotary member, in the gear housing H2. The front end of the shaft coupling 40 is connected to the rear end of the rotary shaft 19. The rotary member includes the shaft coupling 40 and the output shaft 41. Note that a rotary unit includes the rotary member and the rotary shaft 19.

A lip seal 50 is placed in the motor housing H3 for sealing the output shaft 41 to the motor housing H3. In the present embodiment, the lip seal 50 serves as a shaft seal device. Also, a lip seal 55 is placed in the rear housing 14 of the pump housing H1 for sealing the rotary shaft 19 to the rear housing 14. Further, in a similar manner, a lip seal 56 is placed in the rear housing 14 of the pump housing H1 for sealing the rotary shaft 20 to the rear housing 14. In the present embodiment, each of the lip seals 55 and 56 serve as a shaft seal device. Therefore, even in the same vacuum pump housing, communication between the atmosphere in the pump housing H1, which is located at the pumping mechanism P side, and the atmosphere in the motor housing H3, which is located at the electric motor M side, is blocked by the lip seals 50, 55 and 56.

Driving force of the electric motor M is transmitted to the rotary shaft 19 through the shaft coupling 40 while transmitted to the rotary shaft 20 through the shaft coupling 40 and the transmission gear 39. The rotary shaft 20 and the rotor 28 are rotated in the opposite direction to the rotary shaft 19 and the rotor 23 by placing the transmission gear 39 between the rotary shafts 19 and 20 in the gear housing H2. The gas in the semiconductor machining apparatus, which is placed on the outside of the cover 51, is first introduced into the pump chamber 18, which is adjoined to the front housing 13. The gas in the pump chamber 18, which is adjoined to the front housing 13, is then transferred to the pump chamber 18, which is placed at the rear side of the pump chamber 18 and is adjoined to the pump chamber 18, through the passage 17 of the partition wall 16 by the rotation of the rotors 23 and 28 in the pump chamber 18. In a similar manner, the gas in the pump chamber 18 is transferred from the front side to the rear side while reducing its volume in turn. The gas transferred into the pump chamber 18, which is adjoined to the rear housing 14, is exhausted toward the exhaust gas treating apparatus, which is placed on the outside of the cover 51 and is not shown in FIG. 1.

After the operation of the vacuum pump is stopped in a state that solidified matter of the reaction product exists inside of the vacuum pump, when the vacuum pump is operated once again, the vacuum pump requires an excess amount of starting torque thereof. Thereby, depending on the electric motor M, it can become impossible that the vacuum pump re-starts. Specifically, during the operation of the vacuum pump, the rotary shafts 19 and 20 are expanded in the directions of the rotary axes thereof due to a rise in temperature of the vacuum pump. Thereby, a clearance between the rotor 23, which is integrally formed with the rotary shaft 19, and for example the partition wall 16, which faces the rotor 23, in the direction of the rotary axis of the rotor 23 is increased. Also, a clearance between the rotor 28, which is integrally formed with the rotary shaft 20, and for example the partition wall 16, which faces the rotor 28, in the direction of the rotary axis of the rotor 28 is increased. Since the rotary shafts 19 and 20 are located in the directions of rotary axes thereof by the double-row ball bearings 22, if the operation of the vacuum pump is stopped, the clearance is reduced as a consequence of a drop in temperature of the vacuum pump. Therefore, if the solidified matter gets into the clearance between the rotor 23 and the partition wall 16, the clearance is reduced due to a drop in temperature of the vacuum pump. Thereby, the rotor 23 and the partition wall 16 are pressed and adhered to each other so as to sandwich the solidified matter. Also, if the solidified matter gets into the clearance between the rotor 28 and the partition wall 16, the clearance is reduced due to a drop in temperature of the vacuum pump. Thereby, the rotor 28 and the partition wall 16 are pressed and adhered to each other so as to sandwich the solidified matter.

In the present embodiment, in order to maintain the vacuum pump before re-starting the vacuum pump, namely, in order to release adhesion between the rotors 23 and 28, and the partition wall 16, the vacuum pump is structured as follows.

Figure 2A:
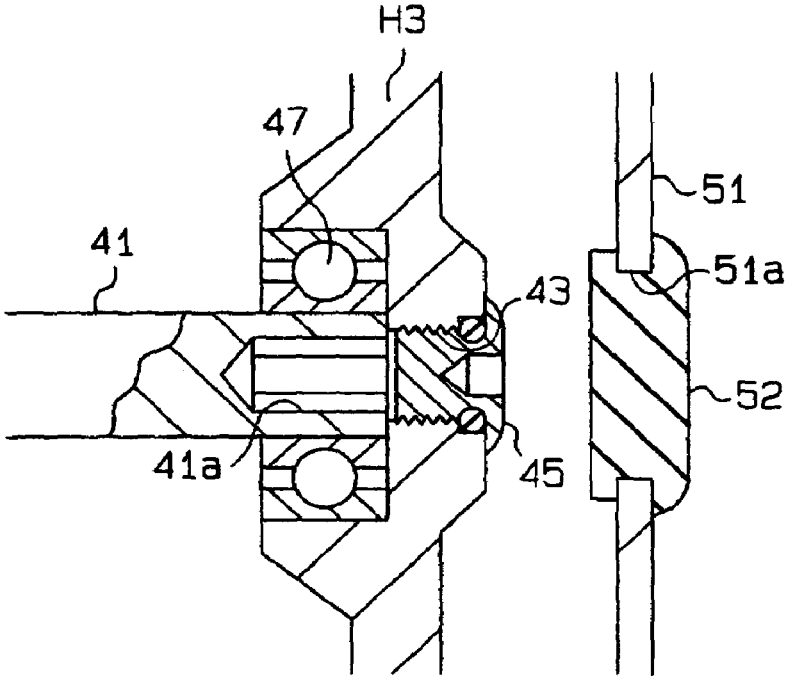
FIG. 2A is a partially enlarged view of FIG. 1.
Figure 2B:
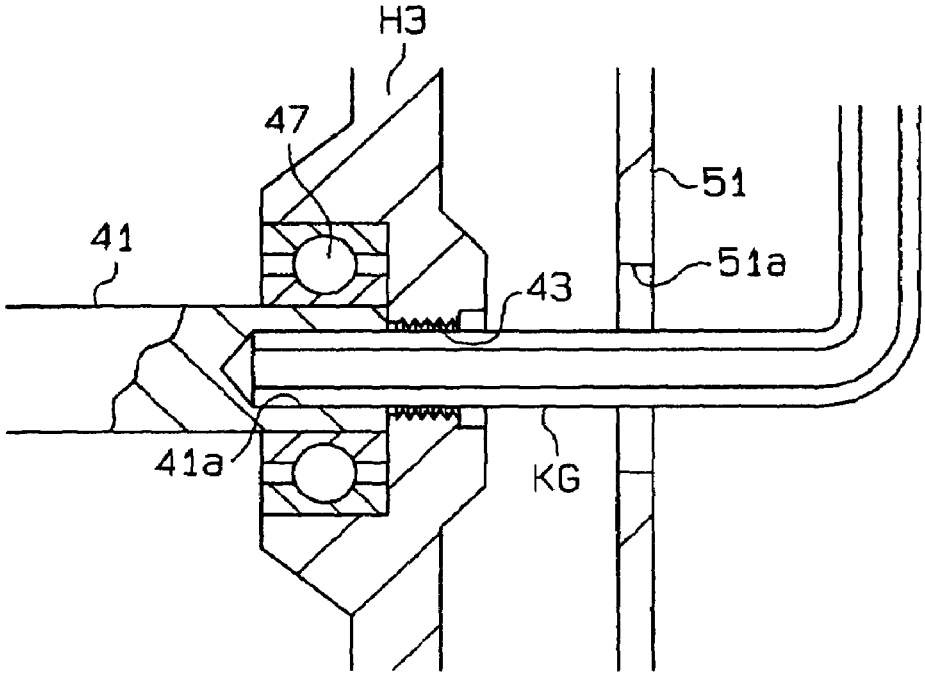
FIG. 2B is a view illustrating a process of maintenance of the vacuum pump according to the first preferred embodiment of the present invention.

As shown in FIGS. 1, 2A and 2B, in the electric motor M, a hexagon socket 41*a* is formed on an end surface of the rear end of the output shaft 41, which serves as a rotary member. The rear end of the output shaft 41 and the shaft coupling 40 are located at the opposite side of the output shaft 41. The hexagon socket 41*a* serves as an engaging portion. A tool insertion hole 43 extends through the rear wall of the motor housing H3 so as to face the hexagon socket 41*a* of the output shaft 41. The tool insertion hole 43 serves as an allowing means. As shown in FIG. 2A, during the operation of the vacuum pump, the tool insertion hole 43 is blocked by a sealing bolt 45, which seals the tool insertion hole 43. In the present embodiment, the sealing bolt 45 serves as a means for opening and closing a tool insertion hole or a tool insertion hole opening and closing means. In contrast, during a stop of the operation of the vacuum pump, as shown in FIG. 2B, the tool insertion hole 43 is opened by removing the sealing bolt 45 from the motor housing H3 when the vacuum pump is maintained.

Referring to FIGS. 2A and 2B, a through hole 51*a* extends through the rear wall of the cover 51 so as to face the tool insertion hole 43. As shown in FIG. 2A, during the operation of the vacuum pump, the through hole 51*a* is blocked by a grommet 52. In the present embodiment, the grommet 52 serves as a means for opening and closing a through hole or a through hole opening and closing means. In contrast, during a stop of the operation of the vacuum pump, as shown in FIG. 2B, the through hole 51*a* is opened by removing the grommet 52 from the cover 51 when the vacuum pump is maintained.

Still referring to FIG. 2B, the grommet 52 is first removed from the cover 51 and then a means for driving a bolt or a bolt driving means, which is not shown in the drawings, is inserted inside of the cover 51 through the through hole 51*a*, when the vacuum pump is maintained during a stop of the operation of the vacuum pump. Thereby, the sealing bolt 45 is removed from the motor housing H3.

In this state that the hexagon socket 41*a* of the output shaft 41 of the electric motor M is exposed to the outside the cover 51, a hexagon wrench KG, which is prepared outside the cover 51, is inserted into and engaged with the hexagon socket 41*a* of the output shaft 41 through the through hole 51*a* and the tool insertion hole 43. In the present embodiment, the hexagon wrench KG serves as a maintenance tool for maintaining the vacuum pump. Therefore, when the hexagon wrench KG is rotated with a relatively large amount of torque caused due to action of a lever thereof although the amount of torque is not expected by the electric motor M, the amount of torque is transmitted from the output shaft 41 to the rotary shaft 19 through the shaft coupling 40. At the same time, the amount of torque is transmitted from the output shaft 41 to the rotary shaft 20 through the shaft coupling 40 and the transmission gear 39. Thereby, such an adhering state that the rotor 23 and for example the partition wall 16 are adhered to each other by the solidified matter is released by force. Also, such an adhering state that the rotor 28 and for example the partition wall 16 are adhered to each other by the solidified matter is released by force. After the adhering state between the rotors 23 and 28, and the partition wall 16 is released, the hexagon wrench KG is removed from the hexagon socket 41*a*. Then, the tool insertion hole 43 is blocked by the sealing bolt 45, and subsequently the through hole 51*a* is blocked by the grommet 52. After this process, the vacuum pump is re-started.

Note that a rotating direction of the hexagon wrench KG upon maintaining the vacuum pump can be the same as or reverse to that of the output shaft 41 of the electric motor M.

According to the first preferred embodiment of the present invention, the following effects are obtained.

(1) As described above, adhesion between the rotors 23 and 28, and the partition wall 16 is released by rotating the rotary shafts 19 and 20 of the pumping mechanism P with the hexagon wrench KG, namely, under a simple maintenance. Therefore, the vacuum pump is re-started without a conventional overhaul. Thereby, trouble of an operator is released.

(2) In the motor housing H3, a tool insertion hole 43 is formed for allowing the hexagon wrench KG to be inserted into the motor housing H3. The hexagon wrench KG is engaged with the output shaft 41 of the motor housing H3 by such a simple structure as the tool insertion hole 43. In addition, the tool insertion hole 43 is closed by attaching the sealing bolt 45 and is also opened by removing the sealing bolt 45. Therefore, during the operation of the vacuum pump, if the tool insertion hole 43 is blocked by the sealing bolt 45, sealing the vacuum pump housing is satisfactorily maintained. Further, when the vacuum pump is maintained, the tool insertion hole 43 is opened by a simple operation such as removal of the sealing bolt 45 from the motor housing H3. Thereby, the hexagon wrench KG can be inserted into the motor housing H3.

(3) In the cover 51, a through hole 51*a* is formed for allowing the hexagon wrench KG to approach the motor housing H3 or the tool insertion hole 43. The hexagon wrench KG is not only inserted into the cover 51 but is also engaged with the output shaft 41 of the electric motor M by such a simple structure as the through hole 51*a*. In addition, the through hole 51*a* is closed by attaching the grommet 52 to the cover 51 and is also opened by removing the grommet 52 from the cover 51. Therefore, during the operation of the vacuum pump, if the through hole 51*a* is blocked by the grommet 52, sealing the cover 51 is satisfactorily maintained. Further, when the vacuum pump is maintained, the through hole 51*a* is opened by a simple operation such as removal of the grommet 52 from the cover 51. Thereby, the hexagon wrench KG can be inserted into the cover 51.

(4) An internal space of the vacuum pump housing between the atmosphere in the pump housing H1 and the atmosphere in the motor housing H3 is blocked by the lip seals 50, 55 and 56. Therefore, as described in the present preferred embodiment, even if the pumping mechanism P handles gas reaction product such as noxious gas generated by the semiconductor machining apparatus and also an internal space of the motor housing H3 is opened to the atmosphere when the vacuum pump is maintained, the operator's safety is sufficiently ensured.

Figure 3A:
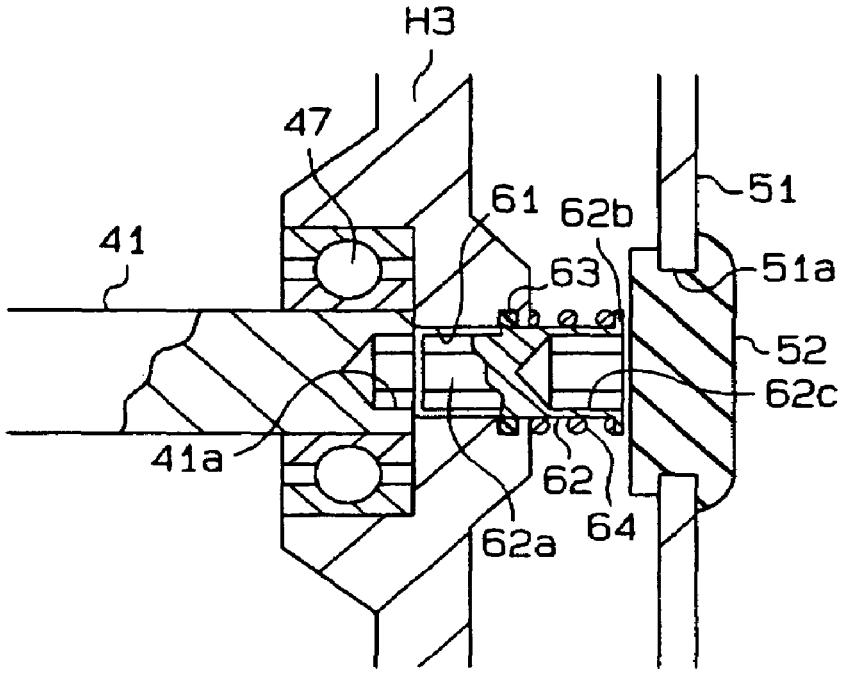
FIG. 3A is a partial view of a longitudinal sectional view illustrating a vacuum pump according to a second preferred embodiment of the present invention.
Figure 3B:
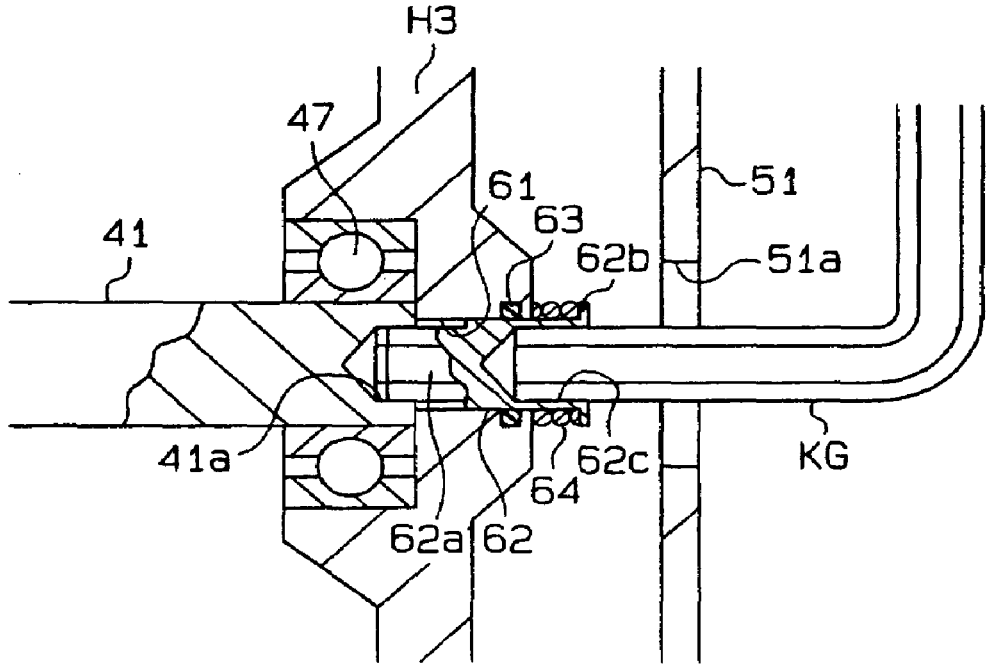
FIG. 3B is a partial view illustrating a process of maintaining the vacuum pump according to the second preferred embodiment of the present invention.

A fluid pump according to a second preferred embodiment of the present invention will now be described particularly with reference to FIGS. 3A and 3B. In the second preferred embodiment, a vacuum pump is also adopted as the fluid pump and only different aspects from the first preferred embodiment are explained. The same reference numerals of the first preferred embodiment are substantially applied to same or corresponding members of the second preferred embodiment and over lapped explanation is omitted. In the second preferred embodiment, the vacuum pump is maintained so as to release adhesion between the rotors 23 and 28, and the partition wall 16 without opening the internal space of the motor housing H3 to the atmosphere.

A round hole 61 extends through the rear wall of the motor housing H3 so as to face the hexagon socket 41*a* of the output shaft 41. A cylindrical intermediate member 62 is inserted into the round hole 61 so as to slide along the direction of the axis thereof and to pivot around the axis thereof. In the present embodiment, the intermediate member 62 serves as an allowing means. The intermediate member 62 has a hexagonal protrusion 62*a* at the front end thereof and a flange 62*b* at the rear end thereof. The hexagonal protrusion 62*a* protrudes frontward and is engaged with the hexagon socket 41*a* of the output shaft 41 of the electric motor M. The flange 62*b* is placed outside the vacuum pump housing and inside of the cover 51. A hexagon socket 62*c* is formed in the rear end surface of the intermediate member 62 so as to engage with the hexagon wrench KG.

A sealing member 63 is interposed between the inner circumferential surface of the round hole 61 and the outer circumferential surface of the intermediate member 62 so as to block communication between the inside and the outside the motor housing H3. The sealing member 63 is an O-ring. A spring 64 is interposed between the outer surface of the rear wall of the motor housing H3 and the front surface of the flange 62*b* of the intermediate member 62, and urges the intermediate member 62 so as to move the intermediate member 62 further away from the output shaft 41. Therefore, in a normal state, the hexagonal protrusion 62*a* of the intermediate member 62 is moved further away from the output shaft 41 by urging force of the spring 64. That is, in the normal state, engaging between the hexagonal protrusion 62*a* of the intermediate member 62 and the hexagon socket 41*a* of the output shaft 41 is released.

When the vacuum pump is maintained, the grommet 52 is first removed from the cover 51 and then the hexagon wrench KG is inserted inside of the cover 51. Thereby, the hexagon wrench KG is inserted into and engaged with the hexagon socket 62*c* of the intermediate member 62. In this state, when the intermediate member 62 is pushed toward an inside of the motor housing H3 against the spring 64 with the hexagon wrench KG, the intermediate member 62 is approached to the rear end of the output shaft 41. Thereby, the hexagonal protrusion 62*a* is inserted into and engaged with the hexagon socket 41*a* of the output shaft 41. Therefore, the hexagon wrench KG and the output shaft 41 are connected to each other through the intermediate member 62 so as to integrally rotate. In this state, adhesion between the rotors 23 and 28, and the partition wall 16 is released by rotating the hexagon wrench KG.

In the present embodiment, similar effects to the effects (1), (3) and (4) of the first embodiment are obtained. In addition, the vacuum pump is maintained so as to release adhesion between the rotors 23 and 28, and the partition wall 16 without opening the internal space of the motor housing H3 to the atmosphere. Therefore, as described in the present embodiment, if the pumping mechanism P handles gas reaction product such as noxious gas generated by the semiconductor machining apparatus, when the vacuum pump is maintained, the operator's safety is further improved.

That is, although in the first and second preferred embodiments an internal space of the vacuum pump housing between the atmosphere in the pump housing H1 and the atmosphere in the motor housing H3 is blocked by the lip seals 50, 55 and 56, the lip seals 50, 55 and 56 do not fully prevent gas in the pump housing H1 from leaking into the motor housing H3. Therefore, in the present structure of the present embodiment, the operator's safety is sufficiently considered.

In the present invention, the following alternative embodiments are also practiced.

In the first and second preferred embodiments, the hexagon socket 41*a*, which serves as an engaging portion, is formed in the output shaft 41 of the electric motor M, which serves as a rotary member. That is, when the vacuum pump is maintained, the rotary shafts 19 and 20 of the pumping mechanism P are rotated through the output shaft 41 of the electric motor M.

In first alternative embodiments to the first and second preferred embodiments, a hexagon socket is formed in the front end surface of the rotary shaft 19 or 20. In alternative embodiments to the first alternative embodiments, a tool insertion hole is formed in the front housing 13 so as to face the hexagon socket. The tool insertion hole allows the hexagon wrench KG to be inserted into the pump housing H1. In other alternative embodiments to the first alternative embodiments, intermediate components 61, 62, 62*a*, 62*b*, 62*c*, 63 and 64, which are similar to the round hole 61, the intermediate member 62, the hexagonal protrusion 62*a*, the flange 62*b*, the hexagon socket 62*c*, the sealing member 63 and the spring 64 of the second preferred embodiment, are formed in the front housing 13 so as to face the hexagon socket. That is, in the first alternative embodiments, the vacuum pump is structured in such a manner that the rotary shafts 19 and 20 are directly rotated by the hexagon wrench KG when the vacuum pump is maintained. In particular, in the latter first alternative embodiments including the intermediate components, even when the vacuum pump is maintained, the internal space of the pump housing H1 is not opened to the atmosphere. Therefore, when the pumping mechanism P handles gas reaction product such as noxious gas generated by the semiconductor machining apparatus, the operator's safety is especially advantageous.

In the first and second preferred embodiments, the hexagon socket 41*a*, which serves as an engaging portion, is formed in the output shaft 41 of the electric motor M, which serves as a rotary member. That is, the vacuum pump is structured in such a manner that the rotary shafts 19 and 20 of the pumping mechanism P are rotated through the output shaft 41 of the electric motor M when the vacuum pump is maintained.

In second alternative embodiments to the first and second preferred embodiments, a gear of the transmission gear 39 is understood as a rotary member, and a gear tooth of the gear is understood as an engaging portion. In addition, a tool insertion hole is formed in the gear housing H2 so as to face the gear tooth of the gear. Further, the vacuum pump is structured in such a manner that when the vacuum pump is maintained, the rotary shafts 19 and 20 are rotated through the transmission gear 39 by engaging a gear tooth of a maintenance tool, which maintains the vacuum pump, with the gear of the transmission gear 39 through the tool insertion hole. In this case, even when the vacuum pump is maintained, the internal space in the pump housing H1 is not opened to the atmosphere. Therefore, when the pumping mechanism P handles gas reaction product such as noxious gas generated by the semiconductor machining apparatus, the operator's safety is especially advantageous.

In the first preferred embodiment, the rotary shaft 19 is connected to the output shaft 41, which serves as a rotary member, through the shaft coupling 40. However, the shaft coupling 40 is not always needed. In third alternative embodiments to the above-described embodiments, the rotary shaft 19 and the output shaft 41 are integrally formed with each other so as to serve as a rotary unit.

In the first preferred embodiment, the sealing bolt 45 is adopted as a tool insertion hole opening and closing means. However, the tool insertion hole opening and closing means is not limited to the sealing bolt 45. In fourth alternative embodiments to the above-described embodiments, however, the tool insertion hole opening and closing means is not limited to the sealing bolt 45. In the present embodiments, a removable panel is adopted as a tool insertion hole opening and closing means. The panel is fixedly joined on the outer surfaces of the housings H1, H2 and H3 so as to cover the tool insertion hole 43.

In the first preferred embodiment, the grommet 52 is adopted as a through hole opening and closing means. In fifth alternative embodiments to the above-described embodiments, however, the through hole opening and closing means is not limited to the grommet 52. In the present embodiments, a removable panel is adopted as a through hole opening and closing means. The panel is fixedly joined on the outer surface of the cover 51 so as to cover the through hole 51*a*.

In all the above embodiments, the tool for maintaining the vacuum pump is a manual tool. In sixth alternative embodiments to the embodiments, however, the tool is not limited to the manual tool. In the present embodiments, an electric tool is adopted as the tool.

In seventh alternative embodiments to all the above embodiments, rusty adhesion between the rotors 23, 28, and the housings H1, H2 and H3, which is caused due to a long-term stopped state of the vacuum pump, is effectively released.

In all the above embodiments, a vacuum pump is adopted as a fluid pump. In eighth alternative embodiments to the embodiments, however, the fluid pump is not limited to the vacuum pump. In the present embodiments, a hydraulic pump or a water pump is adopted as a fluid pump.

Therefore, the present examples and embodiments are to be considered as illustrative and not restrictive and the invention is not to be limited to the details given herein but may be modified within the scope of the appended claims.

What is claimed is:

1. A fluid pump comprising:

a housing;

a drive source accommodated in the housing, the drive source including a rotary member for rotation;

a rotary unit including the rotary member and a rotary shaft, which is operatively connected to the rotary member for rotation, the rotary unit forming an engaging portion for engaging with a maintenance tool which is prepared outside the housing; and a pumping mechanism placed in the housing, the pumping mechanism being operated in accordance with the rotation of the rotary shaft;

wherein an allowing means is formed in the housing for allowing the maintenance tool to engage with the engaging portion so as to face the engaging portion, the rotary shaft being rotated by rotating the maintenance tool in a state that the maintenance tool is engaged with the engaged portion, the allowing means includes an intermediate member that is pivotally places on the housing, the intermediate member being capable of contacting with and moving from the engaging portion and the maintenance tool, the maintenance tool and the rotary member where the engaging portion is formed are connected to each other through the intermediate member so as to integrally rotate by pushing the intermediate member toward an inside of the housing with the maintenance tool.

2. The fluid pump according to claim 1, wherein the drive source is an electric motor.

3. The fluid pump according to claim 1, wherein the engaging portion is formed in the rotary member.

4. The fluid pump according to claim 1, wherein the rotary member is an output shaft.

5. The fluid pump according to claim 1, wherein the engaging portion is a hexagon socket.

6. The fluid pump according to claim 1, wherein the maintenance tool is a hexagon wrench.

7. The fluid pump according to claim 1, wherein the allowing means is a tool insertion hole for allowing the maintenance tool to be inserted into the housing, in which a tool insertion hole opening and closing means is formed for opening and closing the tool insertion hole.

8. The fluid pump according to claim 7, wherein the tool insertion hole opening and closing means is a sealing bolt.

9. The fluid pump according to claim 1, further comprising a cover having its outside, the housing being built in the cover, a through hole being formed in the cover for allowing the maintenance tool to reach the allowing means from the outside so as to face the allowing means, a through hole opening and closing means being formed in the cover for opening and closing the through hole.

10. The fluid pump according to claim 9, wherein the through hole opening and closing means is a grommet.

11. The fluid pump according to claim 1, wherein the housing has a pumping mechanism side and a drive source side therein, the rotary member being an output shaft which constitutes the drive source, the output shaft and the rotary shaft having a power transmission path therebetween inclusive of the output shaft and the rotary shaft, the fluid pump further comprising a shaft seal device in the power transmission path for blocking communication between atmosphere of the pumping mechanism side and atmosphere of the drive source side, the engaging portion being formed in the output shaft.

12. The fluid pump according to claim 11, wherein the shaft seal device is a lip seal.

13. The fluid pump according to claim 1, wherein fluid handled by the pumping mechanism is gas reaction product generated by a semiconductor machining apparatus.

14. The fluid pump according to claim 13, wherein the gas reaction product is ammonium chloride.

15. A fluid pump comprising:

a housing;

a drive source accommodated in the housing, the drive source including a rotary member for rotation;

a rotary unit including the rotary member and a rotary shaft, which is operatively connected to the rotary member for rotation, the rotary unit forming an engaging portion for engaging with a maintenance tool which is prepared outside the housing; and a pumping mechanism placed in the housing, the pumping mechanism being operated in accordance with the rotation of the rotary shaft;

wherein an allowing means is formed in the housing for allowing the maintenance tool to engage with the engaging portion so as to face the engaging portion, the rotary shaft being rotated by rotating the maintenance tool in a state that the maintenance tool is engaged with the engaged portion, wherein the allowing means is a tool insertion hole for allowing the maintenance tool to be inserted into the housing, in which a tool insertion hole opening and closing means is formed for opening and closing the tool insertion hole.

16. The fluid pump according to claim 15, wherein the tool insertion hole opening and closing means is a sealing bolt.

17. A fluid pump comprising:

a housing;

a drive source accommodated in the housing, the drive source including a rotary member for rotation;

a rotary unit including the rotary member and a rotary shaft, which is operatively connected to the rotary member for rotation, the rotary unit forming an engaging portion for engaging with a maintenance tool which is prepared outside the housing;

a pumping mechanism placed in the housing, the pumping mechanism being operated in accordance with the rotation of the rotary shaft;

an allowing means formed in the housing for allowing the maintenance tool to engage with the engaging portion so as to face the engaging portion, the rotary shaft being rotated by rotating the maintenance tool in a state that the maintenance tool is engaged with the engaged portion; and a cover having its outside, the housing being built in the cover, a through hole being formed in the cover for allowing the maintenance tool to reach the allowing means from the outside so as to face the allowing means, a through hole opening and closing means being formed in the cover for opening and closing the through hole.

18. The fluid pump according to claim 17, wherein the through hole opening and closing means is a grommet.

* * * * *